United States Patent [19]

Schubert

[11] 4,202,489

[45] May 13, 1980

[54] REGISTER RESETTING INTERFACE

[75] Inventor: Keith E. Schubert, West Norwalk, Conn.

[73] Assignee: Pitney Bowes Inc., Stamford, Conn.

[21] Appl. No.: 6,617

[22] Filed: Jan. 26, 1979

[51] Int. Cl.[2] ..... G07G 1/00

[52] U.S. Cl. ..... 235/101; 235/130 R

[58] Field of Search ..... 235/101, 130 R; 70/292

[56] References Cited

U.S. PATENT DOCUMENTS

| | | | |
|---|---|---|---|
| 2,339,852 | 1/1944 | Hanson et al. | 235/130 R |
| 3,069,084 | 12/1962 | Barkas et al. | 235/137 |
| 3,251,546 | 5/1966 | Rigo et al. | 235/130R |
| 3,664,231 | 5/1972 | Hanson | 70/292 |
| 3,848,798 | 11/1974 | Riley | 235/101 |
| 3,869,885 | 3/1975 | Uthenwoldt | 70/315 |
| 3,977,222 | 8/1976 | Luperti et al. | 70/292 |
| 3,998,079 | 12/1976 | Uthenwoldt | 70/292 |
| 4,099,049 | 7/1978 | Lowe | 235/101 |

*Primary Examiner*—L. T. Hix

*Assistant Examiner*—Benjamin R. Fuller

*Attorney, Agent, or Firm*—William D. Soltow, Jr.; Albert W. Scribner; Martin D. Wittstein

[57] ABSTRACT

An interface for facilitating user resetting of a mechanical registering mechanism interconnects a decrementing register with a remote meter resetting lock. The user is provided with the current lock combination after debiting the user's account for the amount to be incremented into the register. With the lock released, a resetting knob is rotatable to drive a gear train which engages a pinion on a register numeral wheel. Rotation of the knob initially releases numeral wheel lockout combs to permit the gear train to advance the numeral wheel. A separate gear train is provided for each register wheel to be reset with a Geneva transfer tooth in the driven gear train indexing an adjacent gear train which drives a higher order numeral wheel. The interface additionally provides for conventional meter resetting by authorized personnel through the implementation of manually actuatable thumb wheels for optionally driving the gear trains.

12 Claims, 7 Drawing Figures

REGISTER RESETTING INTERFACE

BACKGROUND OF THE INVENTION

1. Field of the Invention

The invention relates generally to metering devices and, more specifically, to mechanisms for resetting registers.

2. Brief Description of the Prior Art

The prevalent prior practice for resetting postage meter registers entailed the manual resetting of numeral wheels by authorized postal service personnel. To gain access to the meter registers for such procedure, a seal was required to be broken which released a plate normally covering a lock keyway. Thereafter, a key was inserted into the keyway and the lock cylinder rotated to access the register mechanism.

Once the register mechanism was accessed the postal service personnel employed a technique known as "picking" which entailed the rotation of selected numeral wheels with a hand-held stylus.

The plate which guarded the keyway engaged an internal shaft for the purpose of releasing a plurality of lockout combs which prevented rotation of register wheels beyond a zero balance indication. The lockout combs were required to be released in order to free the register wheels for the picking operation.

It may very well be appreciated that manual resetting of postage meters was a cumbersome and time consuming procedure which required the opening of the meter with a possibility of damage to the meter and register mechanism.

SUMMARY OF THE INVENTION

The present invention comprises a register resetting interface which includes low mass gear trains, each of which directly engages an overflow numeral wheel of a postage meter decrementing register. One gear train is driven by a rotatable knob of a remote meter resetting device with the knob being released for rotation upon the user entry of a sequentially changing preselected combination.

Rotation of the meter resetting knob initially drives a release mechanism shaft which rotates to effect disengagement of a plurality of numeral wheel lockout combs to facilitate the resetting of individual numeral wheels. Further rotation of the knob provides rotation of the gear train to increment a numeral wheel by a fixed value. When the driven numeral wheel increments past a transition point, a Geneva tooth in the driven gear train indexes a parallel gear train which engages the next higher order numeral wheel to advance the higher order wheel.

Optional manual resetting of the register by authorized postal service personnel is implemented through a conventional key lock, access to which is available only after a seal is broken and a guard plate rotated. Rotation of the guard plate engages the lockout comb release mechanism. With the key inserted, the register wheels may be reset without a stylus by rotating auxiliary thumb wheels for each of the numeral wheels, each thumb wheel being in engagement with the gear train of each numeral wheel.

From the foregoing compendium, it will be seen that it is an object of the present invention to provide a register resetting interface of the general character described which is not subject to the disadvantages aforementioned.

It is a further object of the present invention to provide a register resetting interface of the general character described which simplifies meter resetting procedures.

Another object of the present invention is to provide a register resetting interface of the general character described which engages and drives numeral wheels yet does not significantly increase system inertia.

Still another object of the present invention is to provide a resettable postage meter of the general character described which permits both user resetting of a register balance through a rotatable remote meter resetting lock or conventional register resetting by official personnel.

Yet another object of the present invention is to provide a register resetting interface of the general character described which is adapted for resetting of conventional postage meter registers.

A further object of the present invention is to provide a register resetting interface of the general character described which is economical and well suited for production by mass fabrication techniques.

Another object of the present invention is to provide a resettable postage meter of the general character described which permits user resetting of postage balance registers while maintaining meter security.

Other objects of the present invention in part will be obvious and in part will be pointed out hereinafter.

With these ends in view, the invention finds embodiment in certain combinations of elements and arrangements of parts by which the said objects and certain other objects are attained, all as fully described with reference to the accompanying drawings and the scope of which is more particularly pointed out and indicated in the appended claims.

BRIEF DESCRIPTION OF THE DRAWINGS

In the accompanying drawings in which is shown one of the possible exemplary embodiments of the invention.

DESCRIPTION OF THE PREFERRED EMBODIMENT

Figure 1:
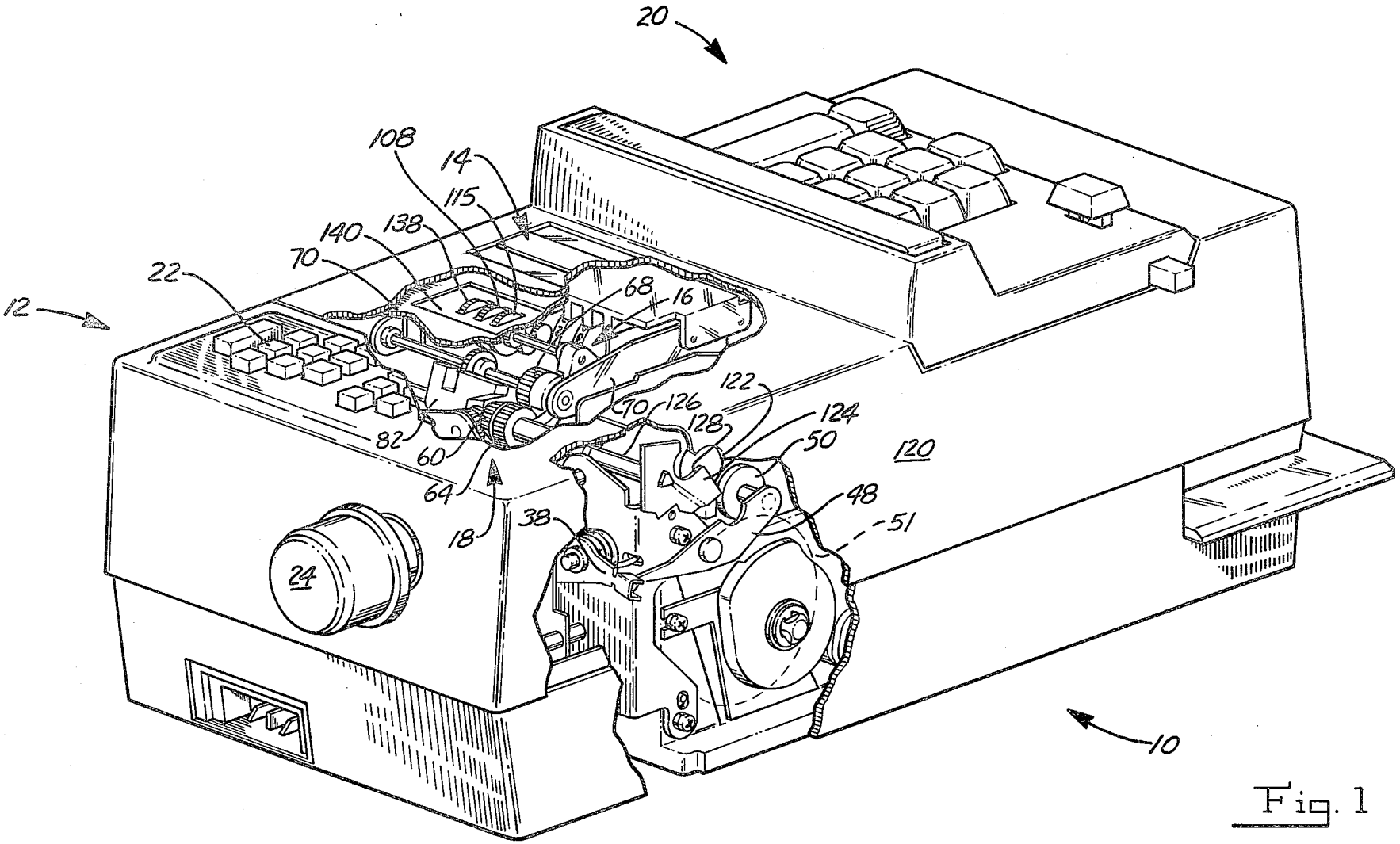
FIG. 1 is a perspective illustration of a typical postage meter including a remote meter setting device and a register resetting interface constructed in accordance with and embodying the invention interconnecting a decrementing register of the meter with the remote meter resetting device and with portions of the meter housing and internal structure broken away and deleted for the purpose of better illustrating the present invention.

Referring now in detail to the drawings, the reference numeral 10 denotes generally a postage meter including a remote meter resetting device 12 adapted to permit the meter user to reset a mechanical register mechanism 14 for the purpose of adding a predetermined value increment to a decrementing register 16. In accordance with the present invention, a register resetting interface denoted generally by the reference numeral 18 is provided for the purpose of interconnecting the resetting device 12 and the register mechanism 14.

The register resetting interface 18 is specifically designed to provide a substantially low mass increment to the register mechanism 14 thereby maintaining low system inertia in its numeral wheels and their driving mechanisms. In addition, the interface 18 permits the optional resetting of the decrementing register 16 by official personnel in a manner which represents a significant improvement over that conventionally employed.

The meter 10 is typically a conventional postage meter with a mechanical register similar to the "Touchmatic" postage meter, model 5700 supplied by Pitney Bowes, Inc. of Stamford, Connecticut. A conventional keyboard 20 is positioned at one end of the meter 10 for entry of postage values to be dispensed and actuation of a printing cycle. During a postage printing cycle, the register mechanism 14 is actuated to record the value imprinted at a pair of registers, one register being incremented to indicate the total accumulated value dispensed by the meter 10 while the other register 16 is decremented a corresponding amount.

The operation of the register mechanism 14 is generally shown in U.S. Pat. No. 3,069,084 issued Dec. 18, 1962 to Barkas et al, assigned to the assignee of the present invention, and incorporated herein by reference. As described in the Barkas patent, upon each postage printing transaction, as ascending and descending register are actuated in a complementary relationship by a rack which engages a pinion associated with a register wheel unit of each register.

Each of the registers includes a plurality of integral register wheel units in successive denominational orders with each register wheel unit comprising a numeral wheel, a pinion, a primary transfer element and a secondary transfer element. Upon rotation of any register wheel through a transfer position, e.g. from 0 to 9 in the decrementing register 16, the primary transfer element of the register wheel sets a transfer actuator associated with the register wheel of the next higher denominational order to a retracted position. Subsequently, all of the retracted transfer actuators are driven back to their normal position by a driving member in each register to effect an advance of each register wheel associated with a retracted transfer actuator one digit to provide a primary transfer.

As further disclosed in the Barkas patent, the rotation through a transfer position of any register wheel by a primary transfer to the register wheel effects a secondary transfer element to positively drive the transfer actuator of the next higher denominational order from a normal position to an advanced position to effect a secondary transfer.

It should be understood that for the purpose of more clearly disclosing the present invention, only a portion of the register mechanism 14 has been shown. Accordingly, the racks, the ascending register as well as the primary and secondary transfer actuators and their associated driving means have been omitted from the illustrations of the present invention.

The remote resetting device 12 is mounted adjacent the register mechanism 14 and is constructed substantially as disclosed in U.S. Pat. No. 3,664,231 issued May 23, 1972 to Hanson and assigned to the assignee of the present invention. As disclosed in the Hanson patent, the device 12 incorporates a combination lock having a secure housing which carries a tape prepunched with a succession of unpredictable combination codes. Release of the lock is effected upon the user depressing a plurality of keys 22 corresponding to a sequential code prepunched in the tape.

Improvements in the locking device of the Hanson patent are illustrated in the U.S. Pat. No. 3,869,885 issued Oct. 1, 1973 to Uthenwoldt, U.S. Pat. No. 3,977,222 issued Aug. 31, 1976 to Luperti et al, and U.S. Pat. No. 3,998,079 issued Dec. 21, 1976 to Uthenwoldt, all assigned to the assignee of the present invention and all of which are incorporated herein by reference.

The remote resetting device 12 includes a hand actuatable knob 24 which is rotatable upon release of the combination lock subsequent to the depression of appropriate keys to match the coded tape. It should be understood that in order to more clearly disclose and illustrate the present invention, several details of the remote resetting device 12 have been omitted from the illustrations.

Figure 3:
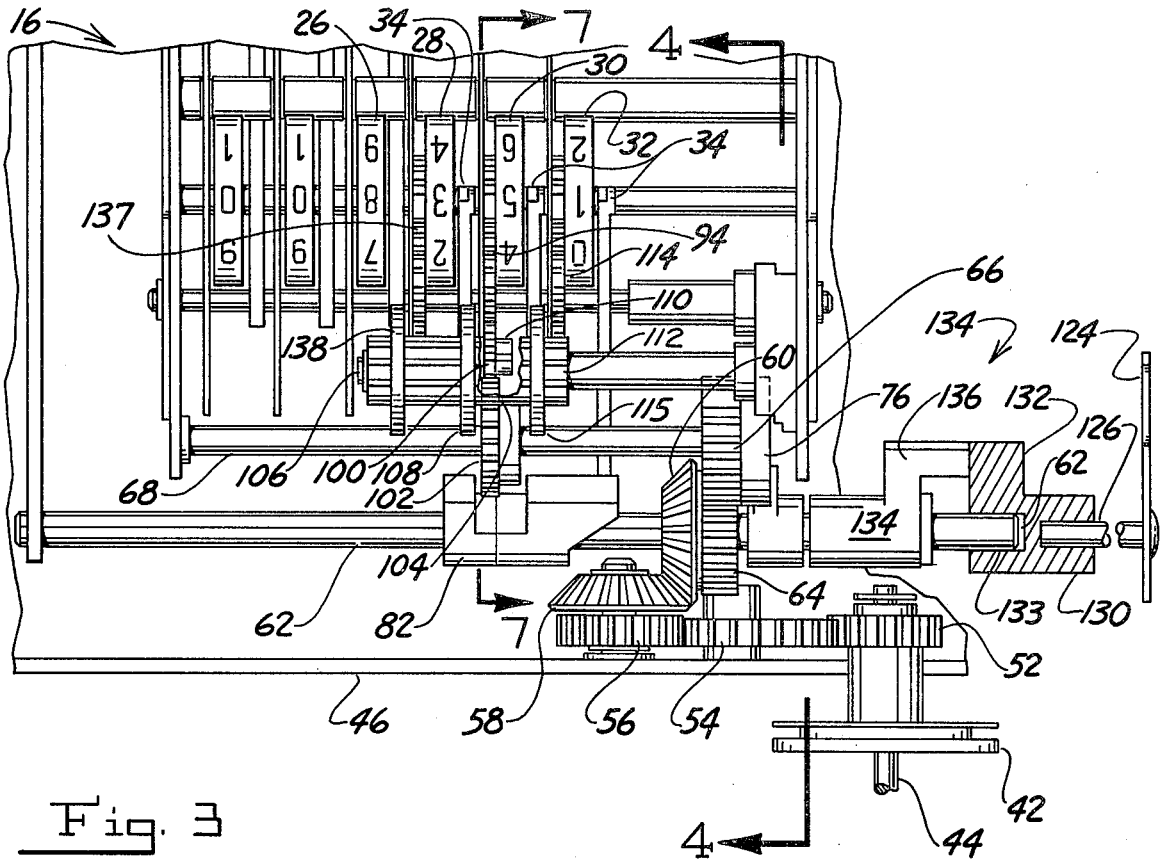
FIG. 3 is an auxiliary plan view of a portion of the decrementing register and illustrating the register resetting interface; additionally shown is the engagement between a key plate and a lockout release mechanism to permit optional resetting of the meter register by postal service personnel.
Figure 6:
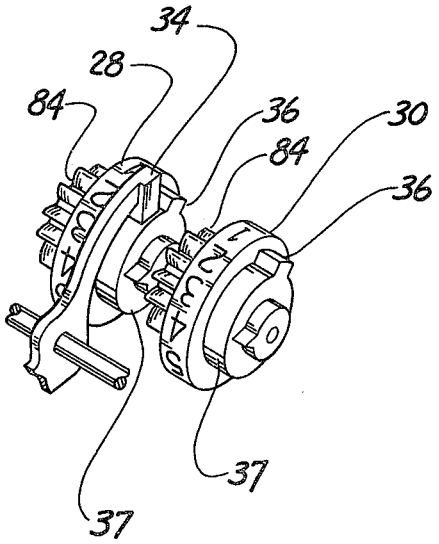
FIG. 6 is an enlarged perspective illustration of two adjacent numeral wheels of the decrementing register with the spacing between the wheels exaggerated for the purpose of better illustrating an integral pinion of each numeral wheel which is engaged by a gear train as shown hereinafter.

The decrementing register 16 of the register mechanism 14 includes a set of first order numeral wheels, the numeral values of which descend upon digitation through the rack mechanism as more clearly set forth in the said patent to Barkas. One of the first order numeral wheels designated by the numeral 26 is shown in FIG. 3. In addition to the first order numeral wheel set, the decrementing register 16 includes an overflow set comprising a plurality of second order numeral wheels designated 28, 30 and 32. These overflow numeral wheels are decremented by the primary and secondary transfer elements upon the highest order numeral wheel of the first order set passing a transition point. It is the overflow numeral wheels that store postage added values and are incremented by additional postage values during the postage resetting procedure.

The "Touchmatic" postage meter includes a plurality of lockout combs 34 (FIGS. 3-6) which engage a hub 37 and abut a lockout stop 36 of each overflow numeral wheel to prevent the overflow numeral wheels from decrementing past a transition point, i.e. below a zero balance. The combs 34 sequentially engage each hub 37 with the comb 34 of the highest order wheel 32 continually engaging its hub and the comb 34 of the next highest order wheel 30 only engaging its hub 37 after the wheel 32 has been locked out to prevent further decrementing. With all the lockout combs abutting their stops 36, the register mechanism 14 will be prevented from drawing further value increments from the decrementing register 16 and the user will then be obligated to add additional postage values to the meter.

Figures 2, 4, 5:
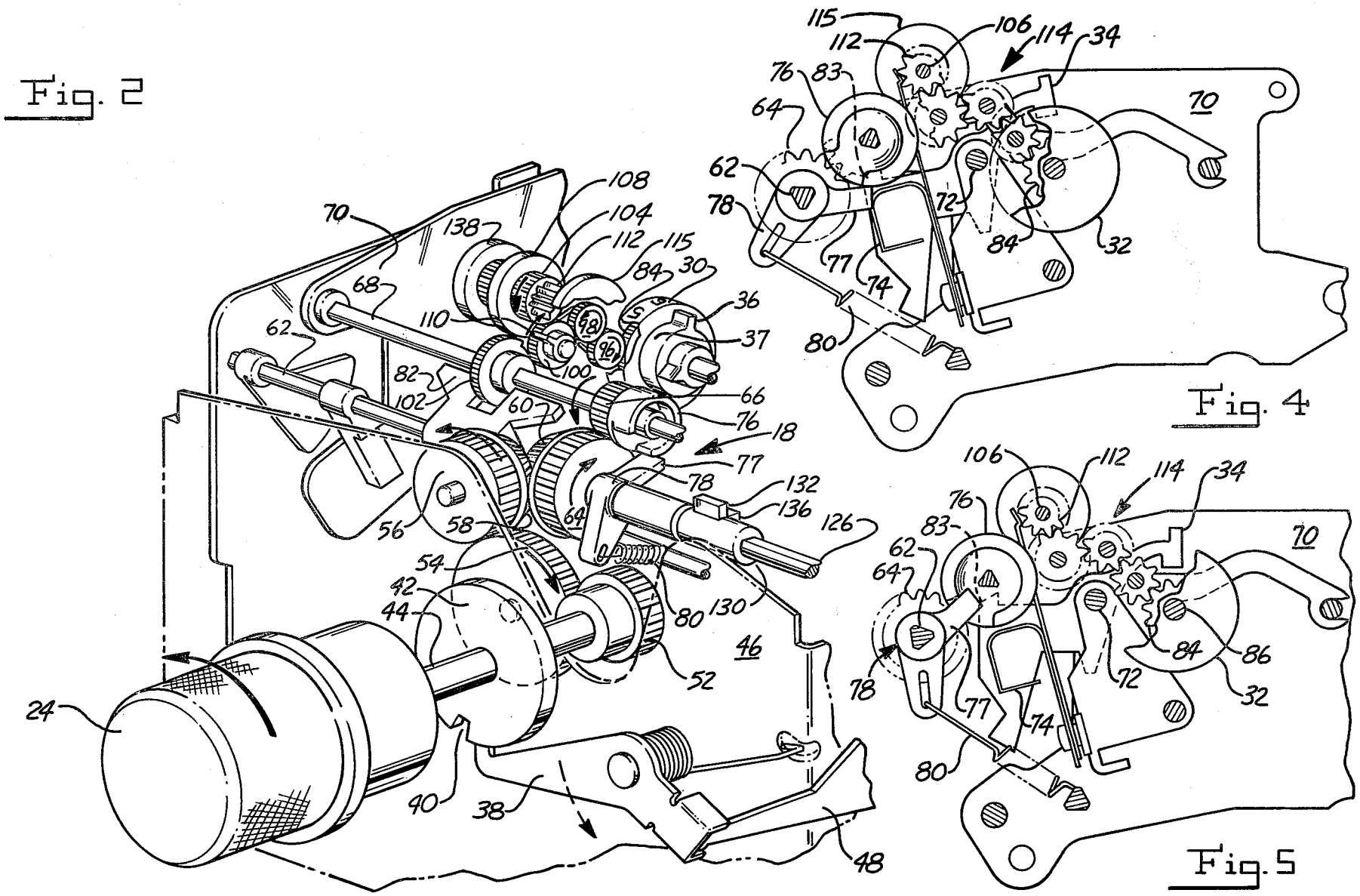
FIG. 2 is a fragmentary perspective illustration of some of the components of the register resetting interface, the resetting device and the meter, with portions deleted for the purpose of better illustrating the manner in which the interface is operable to advance a numeral wheel of the decrementing register.
FIG. 4 is a sectional view through a portion of the register mechanism and the interface, the same being taken substantially along the line 4—4 of FIG. 3 and with various components omitted and showing the interface during a resetting cycle.
FIG. 5 is a sectional view similar to that of FIG. 4 and showing the interface at the termination of the resetting cycle.

Referring now to FIG. 2, it will be seen that after the correct combination has been entered through the keys 22 of the resetting device 12, the knob 24 can be rotated only if a biased pawl 38 is disengaged from a stop notch 40 formed in a disc 42 which is fixed to a shaft 44 to which the knob 24 is mounted. The disengaged position of the pawl is shown in FIG. 2.

The pawl 38 is pivotally mounted to a register end frame 46 and is positioned by one end of a pivotal link 48, the opposite end of which includes a rolling cam follower 50 (FIG. 1). In the printing cycle of the meter 10, a cam raises the follower 50 to cause the pawl 38 to engage the notch 40 in the disc 42. This engagement inhibits meter resetting during a postage printing cycle. It will be observed that in the illustration of FIG. 2 the resetting interface 18 is in a position just prior to completion of a resetting cycle and thus, the notch is not in registration with the tip of the pawl 38.

Referring now to FIGS. 2 and 3, the knob shaft 44 additionally includes a spur gear 52 fixed to its distal end. Driving engagement between the gear 52 and a pinion 54 journalled to the end wall 46 provides rotation to a follower pinion 56. A straight tooth bevel gear configuration 58 on one face of the follower pinion 56 engages a further bevel gear 60 journalled for rotation on a lockout disengagement shaft 62. The shaft 62 extends along an axis perpendicular to the axis of rotation of the follower pinion 56. A spur gear 64, fixed to the rear face of the bevel gear 60, engages a spur gear 66 which is fixed to a shaft 68. The shaft 68 extends along an axis parallel to the axis of the disengagement shaft 62 and is journalled for rotation in opposed side walls 70 of the register mechanism 14.

As mentioned heretofore, upon initial rotation of the knob 24, the lockout combs 34 are disengaged in order to permit the overflow numeral wheels to be reset. As shown in FIG. 4, it will be seen that each lockout comb 34 is pivoted about a shaft 72. The combs 34 are positioned between the successive overflow numeral wheels 28-30 and 30-32. Additionally, a further comb 34 rests upon the hub 37 of the wheel 32. Each comb 34 will sequentially abut a numeral wheel stop 36 to prevent further decrementing of each overflow numeral wheel beyond a zero balance with the comb of the wheel 32 abutting first and the remaining combs being pivoted into engagement with the hubs 37 of their numeral wheels upon lockout of an adjacent higher order wheel by a leaf spring 74. It should be understood that the lockout combs 34 and their engagement with the numeral wheel stops do not form part of the present invention and have been heretofore employed in the "Touchmatic" meter.

To implement the disengagement of the lockout combs 34 during a resetting cycle, a split cylinder cam 76 is fixed to the spur gear 66 for rotation therewith. The cam 76 is engaged by a wiper arm 77 of a bell crank 78 which is fixed to the disengagement shaft 62. One arm of the bell crank 78 is biased by a spring 80 to urge the lockout shaft 62 in an anticlockwise direction as viewed from FIGS. 4 and 5. The spring bias urges the wiper 77 to bear against the cylinder cam 76.

The components of the interface 18 as shown in FIG. 5 are in a dwell or normal position prior to the initiation of a resetting cycle. In such position, the wiper arm 77 extends into a split or blank area of the cylinder cam 76. A lockout comb disengagement cam 82 (FIGS. 1, 2 and 3) is fixed to the lockout shaft 62 in registration with the lockout combs 34. With the lockout shaft 62 in the position shown in FIG. 5, the cam 82 is not engaging the lockout combs.

Upon initial rotation of the knob 24, however, rotation of the cylinder cam 76 engages the wiper arm 77 and the bell crank 78 pivots in a clockwise direction against the bias of the spring 80 and rotates the lockout shaft 62. Rotation of the lockout shaft 62 drives the disengagement cam 82 against an abutment 83 (shown in broken lines in FIGS. 4 and 5) of the lockout combs 34 to pivot the combs 34 about the shaft 72 and raise the heads of the combs 34 from the hubs 37. With the combs 34 in such disengaged position, the overflow numeral wheels are free from restraints against rotation and may be reset.

Figure 7:
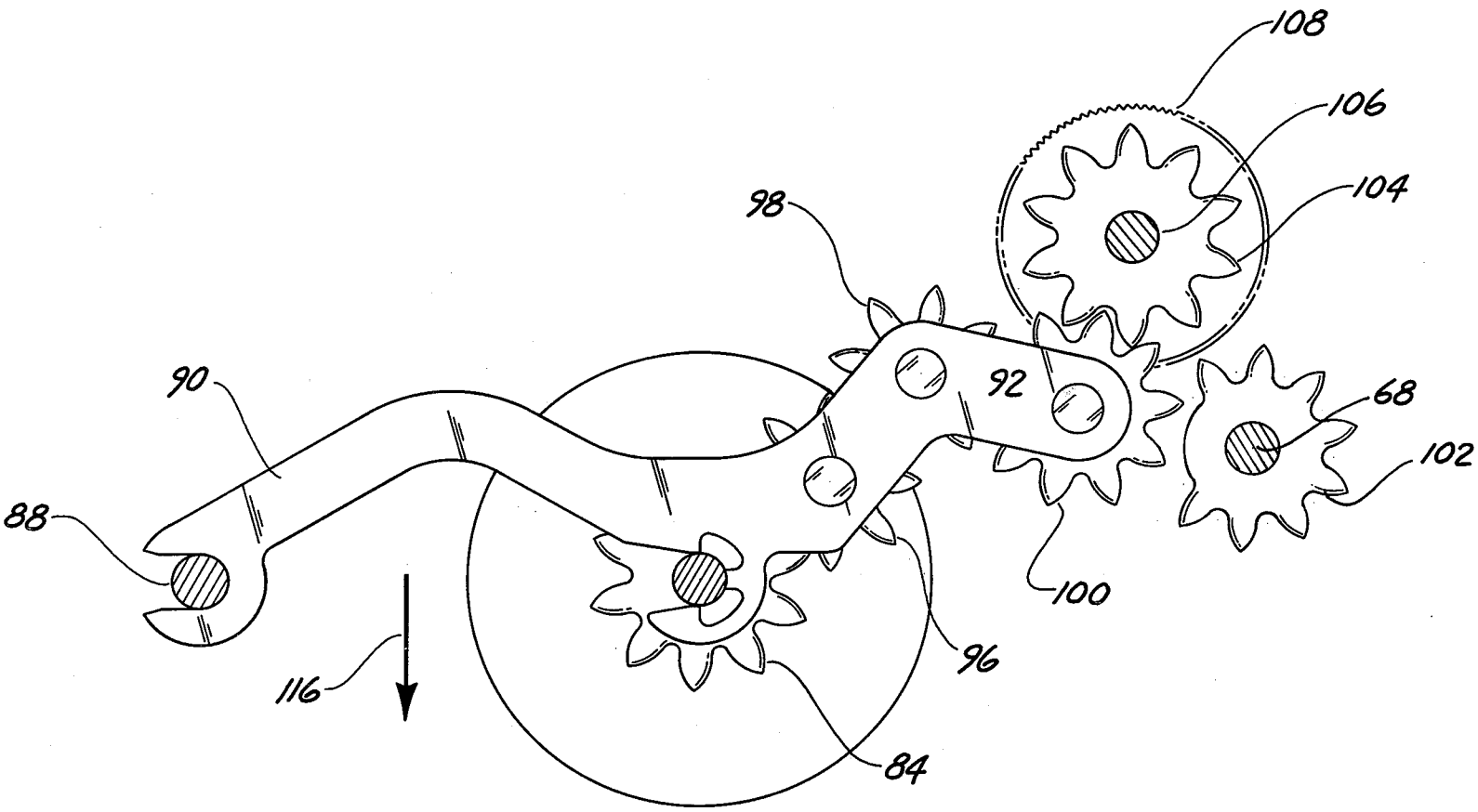
FIG. 7 is a greatly enlarged sectional view through the register mechanism with various elements deleted for clarity and showing a clip to which gears of the numeral wheel resetting gear train are mounted and with the gear train engaging a numeral wheel pinion; additionally shown is an auxiliary thumb wheel which drives the gear train during manual resetting of the numeral wheels.

As previously mentioned, a low mass gear train of the interface 18 drivingly engages selected numeral wheels to facilitate the resetting of the decrementing register 16. Pursuant to the invention, the overflow numeral wheel 30 is directly driven by the interface 18. Each numeral wheel includes an integral pinion 84 and is journalled for rotation about a decrementing register shaft 86 (FIG. 7) along with the remaining numeral wheel units of the decrementing register 16. Additionally shown in FIG. 7 is a shaft 88 which carries the numeral wheel units of the incrementing register.

A gear train mounting clip 90 spans between the shafts 86, 88 and includes "E" spring apertures which engage grooves in the respective shafts. The clip 90 is relatively thin and includes a rearwardly projecting arm 92 to which a low mass gear train 94 is mounted.

The gear train 94 comprises a pinion driving gear 96 which is in continuous engagement with the numeral wheel pinion 84, an intermediate or transfer pinion 98 and a driving pinion 100. It should be appreciated that normal decrementing of the register 16 through the register mechanism 14 as illustrated in the Barkas patent will cause decrementing numeral wheel rotation which, through the pinion 84, will drive the gear train 94. Each numeral wheel which is to be reset includes a similar gear train in engagement with its pinion 84.

In order to increment the numeral wheel 30, a segmented gear 102 is in intermittent engagement with the driving gear 100 of the gear train and drives the gear train 94. From an observation of FIG. 2 it will be seen that the segmented gear 102 is fixed to the shaft 68 and rotates in unison with the spur gear 66 and split cylinder cam 76 which are all driven through rotation of the knob 24.

In the gear orientation as shown in FIG. 7 which coincides with the dwell configuration of FIG. 5, the interface 18 has not as yet commenced a resetting cycle and the gears 100, 102 are not in engagement. Initial rotation of the knob 24 and the shaft 68 advances the segmented gear 102 towards engagement with the driving gear 100 while simultaneously freeing the lockout combs 34 as heretofore mentioned. Upon disengagement of the lockout combs the segmented gear 102 will engage the driving gear 100 and the numeral wheel 30 will be free to rotate to increment the postage available value by a fixed amount as determined by the gear ratios of the respective gears 102, 100, 98, 96 and 84. Rotation of the knob 24 through a complete resetting cycle, e.g. one revolution, drives the gear train 94 and the numeral wheel 30 a fixed numeral increment in an ascending direction.

As shown in FIG. 7, an idler gear 104 which selectively engages the driving gear 100 is journalled about an idler shaft 106 which spans between the register mechanism side walls 70 parallel to the shafts 62 and 68. A thumb wheel 108 fixed to the idler gear 104 may be employed to rotate the idler gear 104 to drive the gear train 94. As will be described hereinafter, the thumb wheel 108 is used during an optional register resetting procedure.

During a resetting cycle, when the numeral wheel 30 passes an ascending transition point, i.e. from 9 to 0, it is necessary to index the next higher order numeral wheel 32. Such indexing is facilitated by a Geneva tooth 110 which is formed as a lateral extension of one tooth of the driving gear 100 (shown in FIGS. 2 and 3). The Geneva tooth 110 engages an idler gear 112 which is journalled about the shaft 106 and increments the idler gear 112 a fixed amount once for each complete revolution of the driving gear 100 which coincides to a complete revolution of the numeral wheel 30. The idler gear 112, in turn, is engageable with the driving gear of a further gear train 114. The further gear train 114 is identical in configuration to the gear train 94 heretofore described and is in engagement with the pinion 84 of the next higher order numeral wheel 32. Thus, the next higher order numeral wheel is incremented a single unit value when the driven numeral wheel 30 passes through an ascending transition point during the resetting cycle. It should be additionally noted that the idler gear 112 also includes a companion thumb wheel 115 for the purpose of facilitating meter resetting during the optional procedure.

Upon the completion of the resetting cycle, the wiper arm 77 of the bell crank 78 will be in registration with the split or gap in the cylinder cam 76 so that the bell crank and disengagement shaft 62 will be permitted to rotate in an anti-clockwise direction under the bias of the spring 80. Such a rotation will release the lockout combs 34 from engagement with the disengagement cam 82, and the combs 34 will pivot about the shaft 72 to their normal positions under the bias of the leaf springs 74.

Referring again to FIG. 7, it should be noted that the register mechanism 14 as disclosed in the Barkas patent provides for a downward displacement of the incrementing and decrementing register shafts 88, 86 respectively and their associated numeral wheels. Such displacement occurs during a printing cycle and is shown by the heavy arrow 116. Since the gear train clips are mounted to the register shafts 86, 88, the gear train 94 and its driving gear 100 drops out of engagement with the idler gear 104 during a portion of the printing cycle.

As heretofore described, the user may directly add postage values by obtaining the next sequential coded combination of the resetting device 12 which will be provided to the user only after the user's account has been debited for the postage to be reset. A further feature of the present invention facilitates optional resetting which may be necessary when, for example, the available combination is not in synchronization with the tape of the resetting device 12, or when the user has not maintained a sufficient balance in its account. In such instances, the present invention permits the user to have authorized postal service personnel directly reset the overflow numeral wheels 28, 30 and 32 after payment for the value of postage to be added. This procedure can be accomplished in a manner similar to that previously employed with respect to the prior Touchmatic meter; however, the present invention utilizes the thumb wheels heretofore mentioned for the purpose of obviating the necessity of picking each of the individual register wheels.

Referring again to FIG. 1, the meter 10 includes a cabinet 120 having a circular aperture 122 which is shown with a portion thereof broken away. The aperture 122 is for the purpose of providing access to a key lock (not shown). Access to the key lock through the aperture 122 is normally prevented by a lock plate 124 which is fixed to the end of a transition shaft 126. The shaft 126 is coaxial with the disengagement shaft 62.

In order to access the key lock, it is necessary to break a postal service seal which prevents movement of the lock plate 124. Thereafter, the plate 124 is rotated clockwise as viewed in FIG. 1 to register a cutout portion 128 with the key lock for insertion of a key.

The pivotal movement of the lock plate 124 rotates the shaft 126 in a clockwise direction. A collar 130 fixed at the end of the shaft 126 includes a radial boss 132 and a socket 133 in which an end of the shaft 62 is journalled (FIG. 3).

In accordance with the invention, rotation of the lock plate 124 to access the keyway provides concommitant rotation of the disengagement shaft 62 through an intermittent linkage.

The intermittent linkage comprises a dog 134 fixed to the disengagement shaft 62 adjacent the end seated in the socket 133. The dog 134 includes a projecting arm 136 which will be engaged by the boss 132 upon rotation of the transition shaft 126 in the clockwise direction. The engagement between the boss 132 and the arm 136 provides rotation of the disengagement shaft 62 to effect the movement of the lockout comb disengagement cam 82 to disengage the lockout combs 34.

It will be appreciated that the engagement provided by the intermittent linkage effects a disengagement of the lockout combs through the interface 18.

After a key is inserted and the lock cylinder rotated by the authorized postal service personnel, the register mechanism 14 is accessed through the release of a door, cover or the like. The postal service personnel may then individually reset any of the overflow numeral wheels by rotation of the available thumb wheels 108, 115.

In order to permit incrementing the decrementing register by an amount below the value indicated as a single numeral increment of the numeral wheel 30, an identical gear train 137 and a thumb wheel 138 are provided for the lowest order overflow numeral wheel 28. The lower order gear train 137 includes a Geneva tooth to increment the next order numeral wheel 30 upon the passage of the numeral wheel 28 through a transition point. The postage meter 10 may further include a guard platform 140 through which each of the thumb wheels 138, 108 and 115 projects to simplify the optional resetting procedure and render the actual wheels inaccessible during the resetting procedure.

Thus, it will be seen that there is provided a register resetting interface which achieves the various objects of the invention and which is well suited to meet the conditions of practical use.

As various changes might be made in the invention as above set forth, it is to be understood that all matter herein described or shown in the accompanying drawings is to be interpreted as illustrative and not in a limiting sense.

Having thus described the invention, there is claimed as new and desired to be secured by Letters Patent:

1. In a postage meter comprising a printing mechanism for dispensing postage and a register mechanism for recording the value of the postage dispensed, the register mechanism including a plurality of numeral wheels, the improvement comprising user accessible resetting means for resetting the register mechanism, a user releasable combination lock engaging the resetting means and linkage means interconnecting the resetting means and the register mechanism, the linkage means including gearing means in continuous engagement with one numeral wheel of the register mechanism and drive means in intermittent engagement with the gearing means, the drive means engaging the gearing means during a resetting cycle to rotate the one numeral wheel in one direction thereby incrementing the total postage value available for printing, the drive means being disengaged from the gearing means to permit rotation of the numeral wheel in an opposite direction to record the dispensing of postage during a printing cycle and optional resetting means for use only by authorized official personnel, the optional resetting means including a thumb wheel, the thumb wheel being in driving engagement with the gearing means and lock means for accessing the thumb wheel, whereby the register may be reset either by the user or official personnel.

2. A postage meter constructed in accordance with claim 1 wherein the register mechanism comprises a decrementing register and an incrementing register, the decrementing register including the one numeral wheel.

3. A postage meter constructed in accordance with claim 1 wherein the resetting means comprises a hand rotatable knob.

4. A postage meter constructed in accordance with claim 1 wherein the drive means includes a segmented gear for providing the intermittent engagement with the gearing means.

5. A postage meter constructed in accordance with claim 1 wherein the numeral wheel includes an integral pinion and the gearing means comprises a gear train in engagement with the pinion.

6. A postage meter constructed in accordance with claim 1 wherein the gearing means comprises a gear train, the register mechanism includes a plurality of numeral wheels journalled about a common shaft, the gear train being positioned between adjacent numeral wheels, and a clip secured to the common shaft, the gear train being mounted to the clip.

7. In a postage meter comprising a printing mechanism for dispensing postage and a register mechanism for recording the value of the postage dispensed, the register mechanism including a plurality of numeral wheels and lockout means for preventing one numeral wheel from decrementing below a rpeselected value, the improvement comprising user accessible resetting means for resetting the register mechanism, a user releasable lock engaging the resetting means and linkage means interconnecting the resetting means and the register mechanism, the linkage means including gearing means in continuous engagement with one numeral wheel of the register mechanism and drive means in intermittent engagement with the gearing means, the drive means engaging the gearing means during a resetting cycle to rotate the numeral wheel in one direction thereby incrementing the total postage value available fpr printing, the drive means being disengaged from the gearing means to permit rotation of the numeral wheel in an opposite direction to record the dispensing of postage during a printing cycle. the linkage means further including means for releasing the lockout means upon initial actuation of the resetting means, the releasing means comprising means engaging the lockout means, a wiper and a cam, the cam being in continual engagement with the drive means, the wiper being in engagement with the cam, the wiper and the means engaging the lockout means being operatively interconnected.

8. A postage meter constructed in accordance with claim 7 including a further numeral wheel indicating postage values of higher denominational order than the one numeral wheel, and a further gearing means in continual engagement with the further numeral wheel, the linkage means including transfer means for engaging the second gearing means upon transition of the first numeral wheel through a transfer point, the transfer means engaging the further gearing means and indexing the further numeral wheel.

9. A postage meter constructed in accordance with claim 8 wherein the first gearing means includes a Geneva tooth, the transfer means including a transfer gear intermittently engageable with the Geneva tooth and drivingly engageable with the second gearing means.

10. A postage meter constructed in accordance with claim 7 wherein the wiper and the means engaging the lockout means are linked by a common shaft, the improvement further comprising optional resetting means, the optional resetting means including means engaging the shaft independently of the wiper to disengage the lockout means and means accessing the register mechanism for manually resetting the numeral wheels.

11. A postage meter constructed in accordance with claim 10 wherein the means accessing the register mechanism includes a thumb wheel, the thumb wheel being in driving engagement with the gearing means.

12. A postage meter constructed in accordance with claim 11 wherein the optional resetting means includes a lock plate and a key lock, the lock plate normally obstructing access to the key lock, the lock plate being rotatable from the normal position, the means engaging the shaft being actuated upon rotation of the lock plate.

* * * * *